US006463858B2

(12) United States Patent
Weber et al.

(10) Patent No.: US 6,463,858 B2
(45) Date of Patent: Oct. 15, 2002

(54) RAIL TIE REPLACEMENT METHOD AND APPARATUS

(75) Inventors: Robert Weber, Wadsworth, IL (US); William D. Straub, Milwaukee, WI (US)

(73) Assignee: Nordco Inc., Milwaukee, WI (US)

( * ) Notice: Subject to any disclaimer, the term of this patent is extended or adjusted under 35 U.S.C. 154(b) by 0 days.

(21) Appl. No.: 09/810,975

(22) Filed: Mar. 16, 2001

(65) Prior Publication Data

US 2002/0129729 A1 Sep. 19, 2002

(51) Int. Cl.[7] ..... E01B 29/00

(52) U.S. Cl. ..... 104/9; 104/6; 104/7.1; 104/17.1

(58) Field of Search ..... 104/9, 7.1, 6, 17.1, 104/17.2, 2, 16, 274; 198/779; 37/105, 117.5, DIG. 3; 294/106, 902

(56) References Cited

U.S. PATENT DOCUMENTS 4,418,625 A * 12/1983 Allmer ..... 104/9
4,770,103 A 9/1988 Allmer
4,872,646 A 10/1989 Siano
4,951,573 A 8/1990 Madison et al.
5,025,733 A 6/1991 Pierobon
5,048,424 A 9/1991 Madison et al.
5,119,723 A 6/1992 Lovitt, Jr.
5,197,389 A * 3/1993 Glomski et al. ..... 104/2
5,305,692 A 4/1994 Madison
5,617,795 A 4/1997 Glomski et al.
5,651,317 A * 7/1997 Kim ..... 104/9
5,722,325 A 3/1998 Glomski
6,158,353 A * 12/2000 Theurer ..... 104/16

* cited by examiner

*Primary Examiner*—S. Joseph Morano
*Assistant Examiner*—Frantz F. Jules
(74) *Attorney, Agent, or Firm*—Greer, Burns & Crain, Ltd.

(57) ABSTRACT

A rail tie replacement apparatus that includes a frame having a first side associated with a first side of a railroad track, and a second side associated with a second side of a railroad track; gripping mechanisms disposed on each of the sides of the frame and configured for grasping rail ties located in the track; and extending members attached to the gripping mechanisms and the frame. The extending members include a first extending member and a second extending member in a non-axial relationship to each other, and configured for positioning the gripping mechanisms relative to the rail ties. The apparatus further includes fluid powered cylinders attached to the extending members and the frame that are configured to facilitate the reciprocal movement of the extending members.

31 Claims, 6 Drawing Sheets

RAIL TIE REPLACEMENT METHOD AND APPARATUS

BACKGROUND OF THE INVENTION

The present invention relates generally to railroad maintenance equipment, and in particular to an apparatus that removes and inserts railroad ties. Railroad ties deteriorate over time due to weather and other factors. Thus, it becomes necessary to remove the old deteriorated railroad ties from the railroad track and replace them with new ties.

In the past, railroad ties were removed and replaced with various types of machines that were designed for that purpose. Generally, the tie replacing machines were built to roll on a railroad track and stop at a rail tie that needed replacement. Most machines have an extending member that positions a gripping device normally relative to the track and adjacent to an end of a rail tie to remove it. The gripping device has vice-like jaws that clamp onto the end of the rail tie. Then, the extending member extends normally away from the track, and thereby removes the tie from under the railroad track. The reverse operation is used to insert a new tie under the track.

Although these prior machines are able to remove and replace the railroad ties, the machines are subject to several disadvantages. One disadvantage is that the extending members on the prior machines are relatively unstable. On the prior machines, the extending members are attached to the railroad repair machine frame at the center of the members. In operation, each member has an inner portion that is slidingly engaged within an outer portion and telescopes away from the frame to position the gripping mechanism relative to the rail tie. The length of the fully extended member places stress at the attachment point where the end of the member meets the frame. This stress often causes the member to sag, work improperly or even break over time. Furthermore, some prior machines only had one extending member, which was attached to a pivot, in order to remove ties from the other side of a track if necessary. These machines experienced additional stress at the attachment point due to the excess movement and vibration on the extending member.

More recently developed machines include two extending members, one on each side of the machine, that are mounted along the same axis. A main support member is situated in the middle of the machine frame and contains the two extending members which are slidingly engaged with each other. This innermost member extends in an opposite direction from the next outer member. In operation, one extending member slides outward within the main support member, and away from the machine frame, towards the location of the rail tie.

The dual in-line extending member design increases efficiency and overcomes the stress experienced by the single pivoting extending member design. These machines can remove a rail tie from either side of a track without pivoting, however stress problems still occur when the extending member is completely extended away from the frame. The full extension places most of the weight of the extending member on the minimal contact point between the extending member and the main support member. Stress is created on the contact point between the main support member and extending member, and failure results.

Another disadvantage with these prior machines is that one long hydraulic cylinder is used to extend a member on either side of the machine. The hydraulic cylinder is attached between the ends of each extending member and fully extends during operation of either extending member. This configuration lacks stability and the full extension of the long hydraulic cylinder eventually leads to sagging and failure, which adds to repair time and costs.

A further disadvantage with prior machines is the use of relatively long wear pads to reduce sliding friction between each extending member and the main support member. The wear pads facilitate smooth movement of the extending members within the main support member, however, uneven wear and "slop" results from operation.

First, the wear pads extend from the outer end of one extending member to the outer end of the other extending member. The sliding friction between the members wears down the pads. Since the prior machines include at least three telescoping units to an extending member, the combined wear of the pads on each unit creates a cumulative excessive displacement or "slop" between the telescoping elements. The cumulative displacement of the telescoping elements of each extending member causes the extending members to sag over time, which restricts the movement of the extending member and reduces its operational efficiency.

Second, the wear on the pads tends to vary along the length of the pads. In most instances, one side of a pad will wear more quickly than the other side. Regardless of which side of the pad wears more quickly, the entire elongated pad still needs to be replaced. Also in the prior machines, the extending members have to be completely disassembled to remove the pads. This process takes substantial time and effort. In addition, while most of the pads are still in good condition, the pads must be replaced due to the wear on only one side. As a result, replacing these pads in this manner is expensive and wasteful.

Yet another disadvantage of conventional railway repair machines is that these machines utilize an extending member configured with three slidingly engaged tubes. Two smaller sized tubes slide within a larger main tube that is connected to the frame of the machine. The smaller sized tubes are each attached to a gripping device and one of these tubes slides within the other tube. Therefore, one extending member is made of a tube that is smaller than the other extending member so that it can slide within the other extending member. This three tube configuration makes replacement of the extending members more difficult and more expensive because each extending member is unique and not interchangeable.

Accordingly, it is the primary object of the present invention to provide an improved rail tie replacement apparatus that includes at least two non-axially aligned extending members attached to the frame and to each other at one end.

It is another object of the present invention to provide an improved rail tie replacement apparatus including fluid powered cylinders in an axial relationship to each other and operate in unison to facilitate faster reciprocal movement of the extending members over prior railway maintenance machines.

It is yet another object of the present invention to provide an improved rail tie replacement apparatus including fluid powered cylinders in an axial relationship to each other for providing increased stability and reducing the incidence of malfunction of the extending members.

It is a further object of the present invention to provide an improved rail tie replacement apparatus having a plurality of wear pads on the ends of each telescoping element of an extending member, to reduce the stress on the extending members and to facilitate pad replacement.

It is still a further object of the present invention to provide a rail tie replacement apparatus having extending members that are identically configured so that the members are interchangeable and may be used to replace a damaged or broken extending member on either side of the apparatus, which provides a reduced inventory and reduction of parts.

BRIEF SUMMARY OF THE INVENTION

The above-listed objects are met or exceeded by the present rail tie replacement apparatus, which features non-axially aligned extending members disposed in a side-by-side relationship, with one member extending in a first direction to service one side of the track and the other extending in an opposite direction to service the other side of the track. The non-axial relationship enhances the stability of the extending members because the members are supported both by the frame and by each other. As the extending members operate on either side of the frame, the stability and operation of the machine is greatly improved over the existing machine due to the non-axial positioning of the extending members on the frame.

Another feature of the present rail tie replacement apparatus is at least two fluid powered cylinders connected to each other at one end and configured to operate in unison to facilitate the stable reciprocal movement of the extending members. Yet another feature of the present apparatus is removable wear pads attached to the extending members. The pads are disposed at the ends of the extending members for easy replacement.

More specifically, the present invention provides a rail tie replacement apparatus that includes a frame having a first side associated with a first side of a railroad track, and a second side associated with a second side of a railroad track. Gripping mechanisms disposed on each side of the frame and are configured for grasping rail ties located in the railroad track. Extending members are attached to the frame and include a first extending member and a second extending member in a non-axial relationship to each other. The extending members are configured for positioning said gripping means relative to the rail ties.

DETAILED DESCRIPTION OF THE INVENTION

Figure 1:
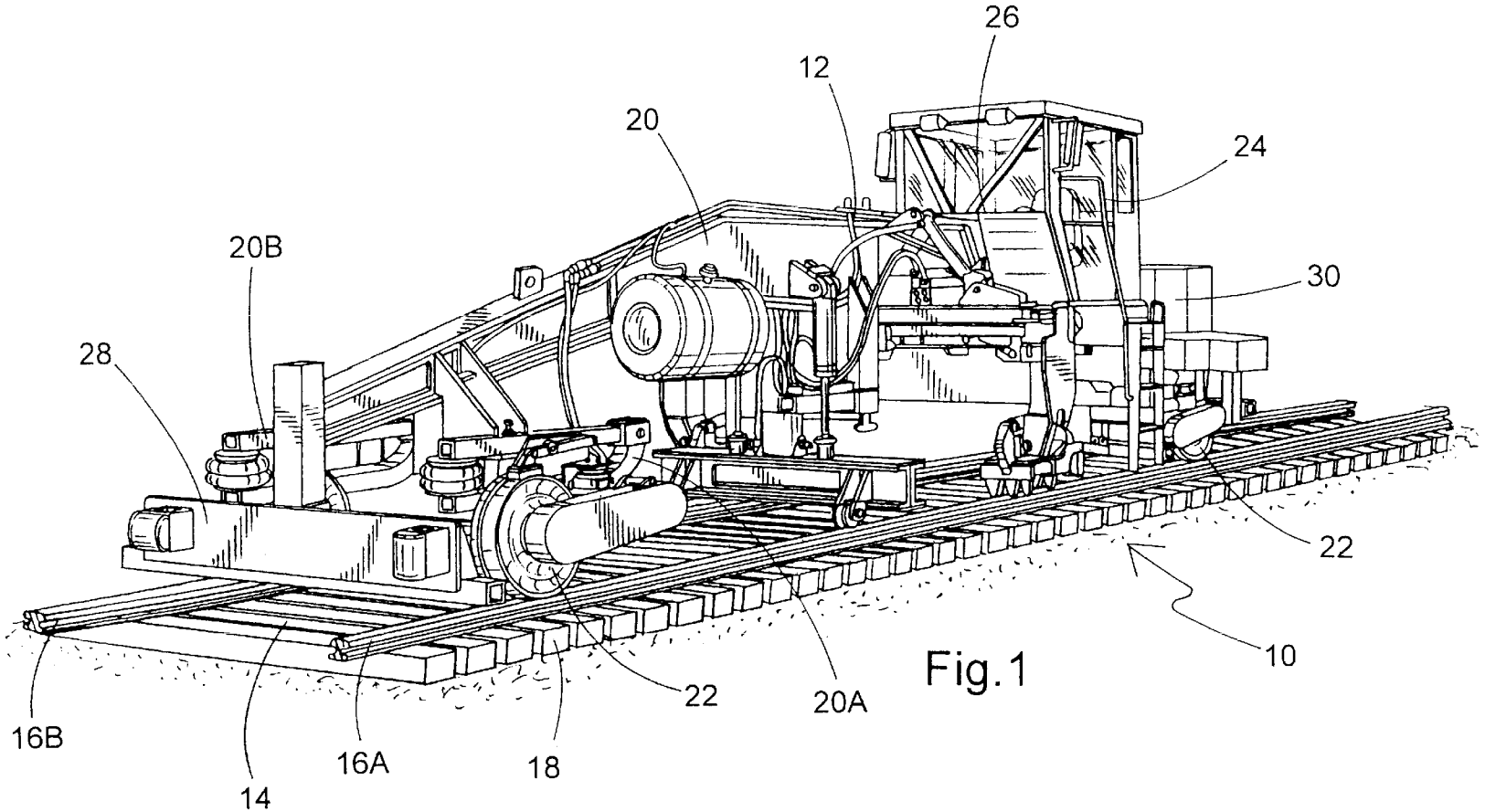
FIG. 1 is a front perspective view of a railroad machine including the present rail tie replacement apparatus.
Figure 2:
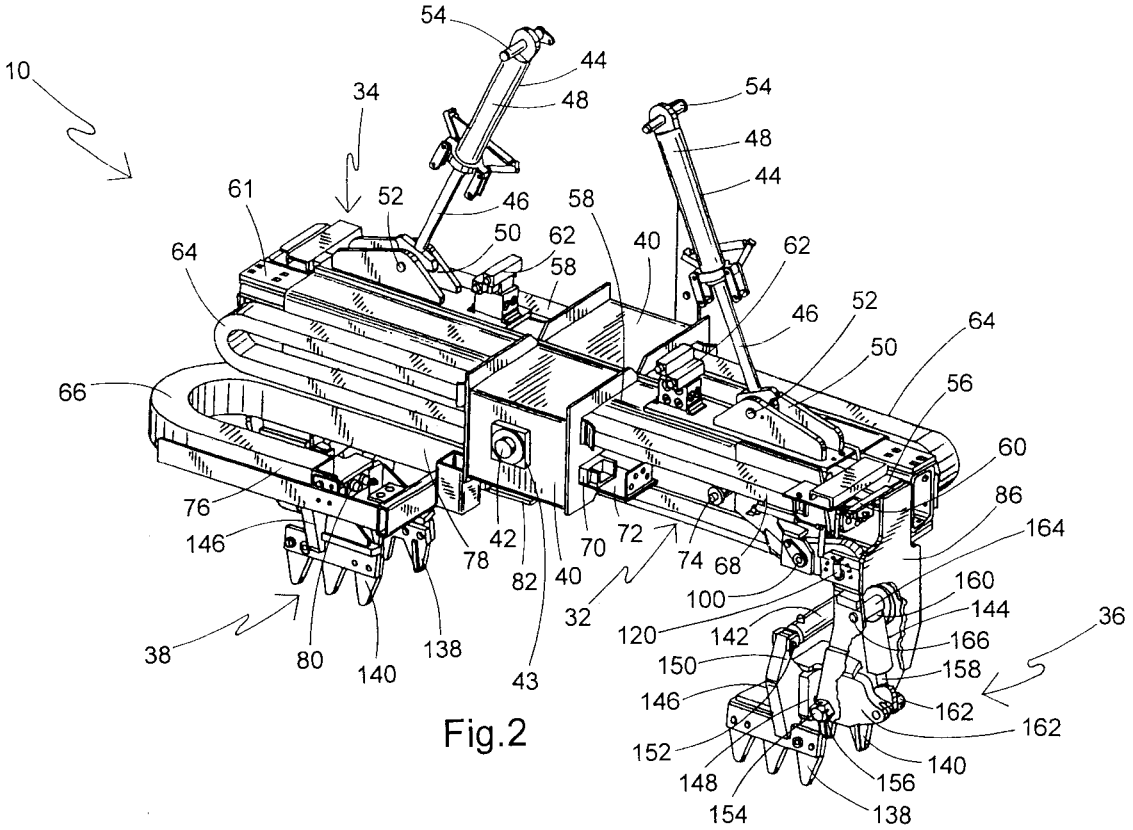
FIG. 2 is a top perspective view of the present rail tie replacement apparatus.

Referring to FIGS. 1 and 2, the present rail tie replacement apparatus is generally indicated at 10 and is attached to a railway repair machine 12. The railway repair machine 12 is preferably designed to be self-propelled on a railroad track 14. It is also contemplated, however, that the apparatus 10 may be configured to be propelled along the track 14 by another vehicle.

The track 14 includes first and second rails 16*a*, and 16*b*, respectively, and a plurality of ties 18. Furthermore, the machine 12 includes a frame 20 supported on a plurality of wheels 22 such that the frame can be driven along the rails 16*a*, 16*b*. The frame 20 supports a source of motive power such as an internal combustion engine (not shown), which propels the machine 12 and also powers a fluid power system (not shown), which in the preferred embodiment is hydraulic, and an operator's cab 24 housing a control system 26.

It will be evident that the frame 20 has a first side 20*a* and a second side 20*b*, each side corresponding to one of the rails 16*a*, 16*b*. In addition, the frame 20 has a first or front end 28 and a second or rear end 30. The operator's cab 24 is situated nearer to the rear end 30 of the machine 12 and enables the operator to observe and control repair operations on either rail 16*a* or 16*b*. Also, an important feature of the present invention (better seen in FIG. 2) is that a first extending member 32 and a second extending member 34 are attached to the frame 20 in a non-axial relationship to each other, and control the positioning of a first gripping mechanism 36 and a second gripping mechanism 38 relative to the plurality of rail ties 18. In the preferred embodiment, the first and second extending members, 32 and 34 respectively, are positioned directly adjacent to each other, but it is also contemplated that first and second extending members may be positioned in spaced apart orientation at other locations along the frame 20.

In existing railroad repair machines, the reciprocal movement of the extending members 32, 34 causes increased stress at an attachment point where the frame and the extending member are connected. Furthermore, when the extending members are fully extended, the weight of each member adds additional stress to the attachment point and the extending member itself. An advantage of the present invention is the non-axial or adjacent positioning of the first and second extending members, 32 and 34.

The non-axial relationship of the members 32 and 34 provides increased stability and strength, and eliminates the conventional attachment point. In the present invention, the stress caused by the reciprocal movement of the extending members 32 and 34 is reduced because of the non-axial or side-by-side positioning of the members 32 and 34. As a result, the operational failure and replacement cost associated with existing machines is decreased substantially with the present apparatus 10.

Figure 3:
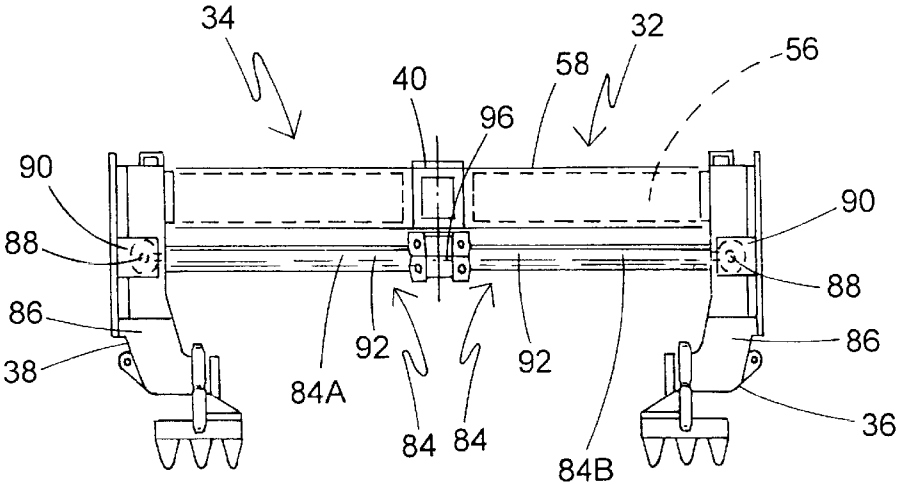
FIG. 3 is a schematic front elevational view of the present rail tie replacement apparatus, with the extending members shown in the retracted position.

Referring now to FIGS. 2 and 3, each extending member 32, 34 operates in the same manner, therefore the operation of only one of the extending members will be described. Each extending member 32, 34 is slidingly engaged and supported by a frame support 40. The frame supports 40 are preferably attached to each other, as by welding, and are attached to the main frame 20 by slider rods 42. One feature of the present invention is that the position of the rail tie replacement apparatus 10 may be vertically adjusted relative to the frame 20 depending on the task to be performed. The slider rods 42 are welded to a side surface of each frame support 40 and fit within corresponding grooves (not shown) formed on the frame 20. A wear plate or roller 43 is also engaged with the frame grooves. The slider rods 42 then matingly engage the corresponding grooves on the frame 20 and vertically slide up or down within the grooves depending on the operation of a pair of hydraulic cylinders 44 that are controlled by the operator.

The hydraulic cylinders 44 control the vertical positioning of the rail tie replacement apparatus 10 within the channels. Each hydraulic cylinder 44 includes a rod end 46 and a blind end 48. The rod end 46 is secured to a bracket 50 with a pin 52. On the opposite end, the blind end 48 is secured to the frame 20 by inserting the blind end into a bracket (not shown) on the frame and securing the attachment with a flanged pin 54, which is attached to the bracket by a threaded fastener or other fastening devices known in the art. In operation, the hydraulic cylinders 44, raise and lower the rail tie replacement apparatus 10 relative to the frame 20, according to an operator's instructions which are transmitted into the control system 26. If an operator wishes to raise the apparatus 10, an instruction is sent via the control system 26 to retract the hydraulic cylinders 44.

In situations where the ground is uneven or a different gripping angle is needed, the operator can adjust the apparatus 10 such that one side of the apparatus 10 is lower than the other side. This tilting process can be achieved by extending or retracting only one or both of the hydraulic cylinders, 44. Once the rail tie replacement apparatus 10 is vertically positioned relative to the track 14, the gripping mechanism, either 36 or 38, is positioned relative to the rail tie 18 that needs repair or replacement.

The gripping mechanisms 36 and 38 are formed horizontally on the same weldment as extending members 32 and 34 respectively. An inner element 56 of each extending member 32 and 34 slides horizontally in and out of the corresponding frame support 40. The first extending member 32 includes the inner element 56 and an outer element 58. The inner element 56 is attached to the first gripping mechanism 36 on a first end 60, and is slidingly engaged within the outer element 58. To provide structural stability, the outer element 58 is secured at an inner end to the frame support 40.

In addition, a manifold 62 is positioned on top of the outer elements 58 of the extending members 32, 34 and is provided with a valve (not shown) as is known in the art, controlling the hydraulic pressures supplied to the various hydraulic components of the gripping mechanisms 36 and 38. The manifolds 62 are secured to the tops of the outer elements 58 by threaded fasteners or other similar fastening device as known in the art.

Furthermore, a first guide hose 64 and a second guide hose 66 are positioned on its side in two different locations along the extending members 32 and 34 to protect hydraulic tubing attached to various components within the rail tie replacement apparatus 10. One end 68 of the first guide hose 64 is fastened to the top of the gripping mechanism 36. An opposite end 70 of the first guide hose 64 is secured to a support plate 72 which is secured to the outer element 58 of the extending member 32. Also, a hose guide roller 74 is situated on the outside surface of the outer element 58 to provide additional support to and facilitate movement of the guide hose 64.

Similarly, the second guide hose 66 has an end 76 and an opposite end 78. The end 76 is secured to a bracket mount 80. An opposite end 78 of the guide hose 66 is attached to a mounted support channel 82 (best seen in FIG. 4). The mounted support channel 82 is welded or fastened to the bottom portion of the frame support 40. As attached, the support channel 82 extends outward and below the frame support 40, as shown in FIGS. 2, 3 and 4, thereby maintaining a planar relationship between the end 76 and the opposite end 78.

Figure 4:
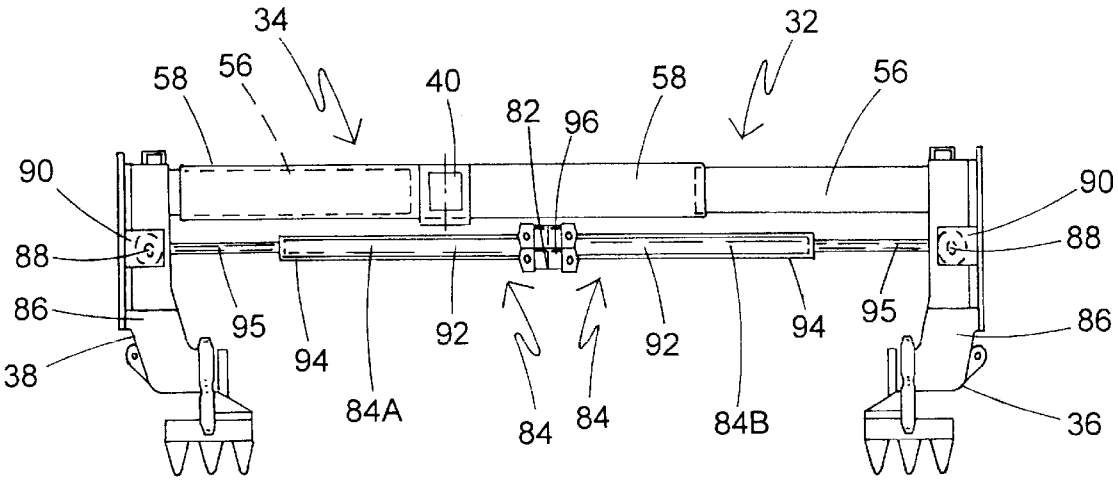
FIG. 4 is a schematic view similar to FIG. 3, but showing one of the extending members in the fully extended position.

Referring now to FIGS. 2, 3 and 4, as the extending member 32 telescopes away from the frame 20, the inner element 56 slides within the outer element 58 until it reaches full extension. Likewise, the guide hoses 64, 66 extend outward with the extending member 32. The inner element 56 is prevented from sliding out of the outer element 58 at a second end 61 by dual fluid powered cylinders 84, which are attached to the gripping mechanism 38. While the present cylinder 84 are preferably hydraulic, pneumatic cylinders are also contemplated, as are other equivalent types of devices or systems (cables, chain drives, etc.) for controlling the movement of one rigid member to another.

Similarly, the inner and outer elements, 56 and 58, respectively, of the second extending member 34 and guide hoses 64, 66, telescope horizontally outward away from the frame support 40, in the opposite direction from the first extending member 32, and towards the second rail **16*b*, to orient the gripping mechanism 38 relative to the second rail. During immobilization, the inner element 56 moves towards the frame support 40 and retracts within the outer element 58**.

Now referring to FIGS. 3 and 4, movement of the first and second extending members, 32 and 34 respectively, is controlled by the double-acting fluid power of hydraulic cylinders 84. Each hydraulic cylinder 84 is attached to housings 86 of the gripping mechanisms 36 and 38 by pins 88 at clevis mounts 90. Other conventional attachment devices may be used to fasten the hydraulic cylinders 84 to the housings 86.

Each hydraulic cylinder 84 has a blind end 92 and a rod end 94. The corresponding blind ends 92 are fastened together by welding, threaded fasteners, or the like, at a bracket 96, while a rod 95 slidably projecting from each of the rod ends 94 is each pivotally attached to a corresponding gripping mechanism 36, 38 as described above. Fastening the hydraulic cylinders 84 in this manner creates a single continuous, substantially linear hydraulic system that extends from the first gripping mechanism 36 to the second gripping mechanism 38. Another advantage of the present apparatus 10 is that by connecting the blind ends 92 of the hydraulic cylinders 84 in unison, the rate of reciprocal movement of the extending members 32, 34 is significantly increased without sacrificing the rigidity or stability of the hydraulic cylinders.

Referring again to FIGS. 3 and 4, the unique assembly of the hydraulic cylinders 84 will be described with respect to a rail tie repair project. During transportation, the first and second extending members, 32 and 34, are retracted to avoid unwanted contact damage. As shown in FIG. 3, the blind ends 92 of the hydraulic cylinders 84, are drained, not pressurized, through pressure applied to the rod ends 94 of hydraulic cylinders 84.

Figure 5:
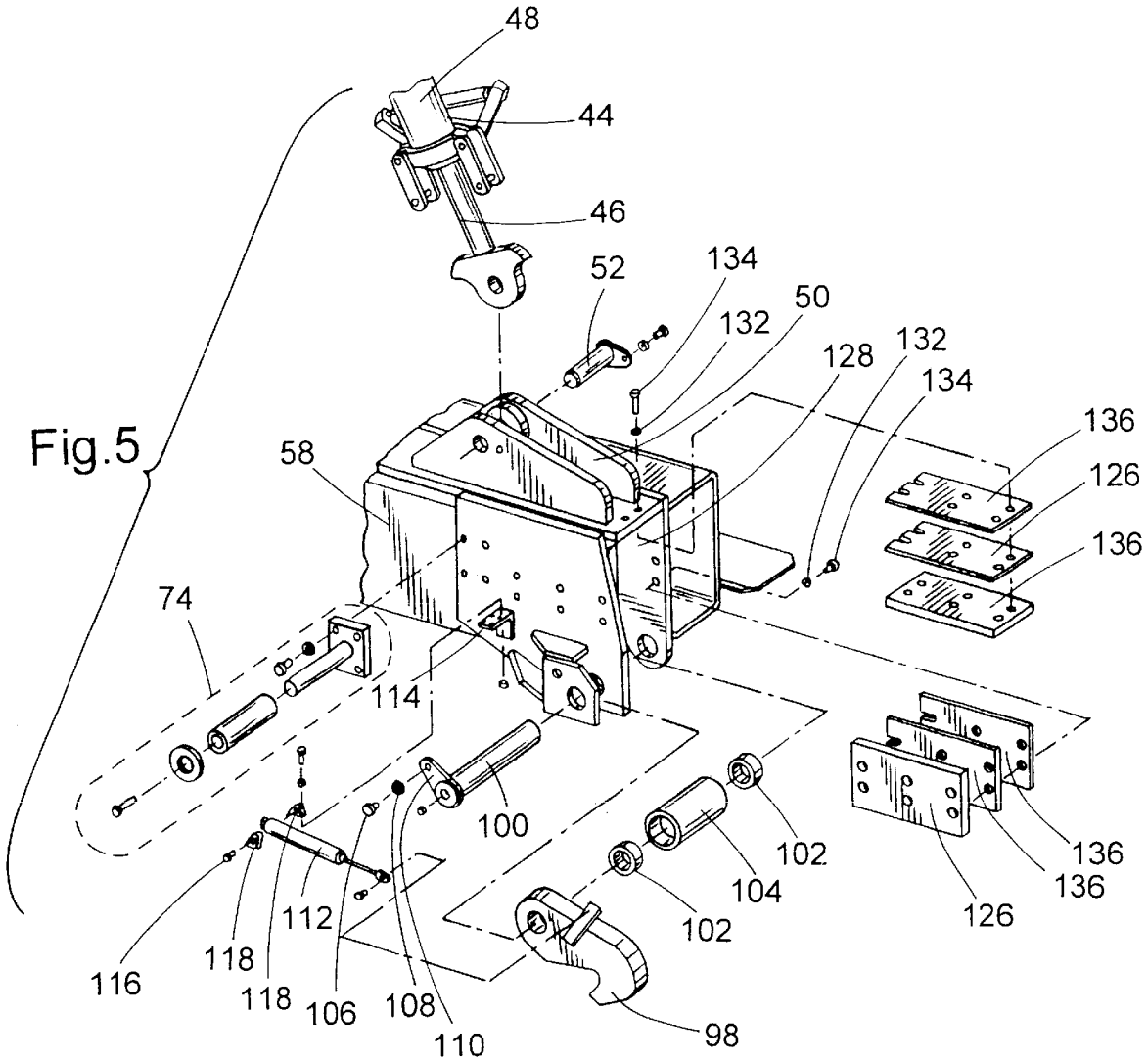
FIG. 5 is a partially exploded perspective view of one of the extending members.

Referring now to FIGS. 3–5, once the rods 95 of the cylinders 84 completely move into the cylinders 84, the extending members 32 and 34 are locked into place with a latch 98 (see FIG. 5). The latch 98 is rotatably attached to the outer element 58 by a lubricating pin 100, which fits within a bearing 102 and a roller 104. The roller 104 is situated inside the outer element 58, and the lubricating pin 100 slides through the latch 98 and then continues through the bearing 102 and the roller 104. The pin 100 is attached to the outer element 58 by inserting a threaded fastener 106 through a washer 108 and a flange 110.

During extension and retraction of the extending member 32 through the operation of the cylinder 84, the inner element 56 rolls or slides along the roller 104. The roller 104 is free to rotate about the pin 100 within the inner element 56. As the inner element 56 moves outward from the frame 20, the roller 104 rotates and reduces the friction between the bottom of inner element 56 and outer element 58. Thus, roller 104 facilitates the reciprocal movement of the extending member 32.

An operator manipulates a small, preferably pneumatic cylinder 112 or other suitable device that is attached between the outer element 58 and the latch 98 to rotate the latch up or down as desired. One end of the cylinder 112 is fastened to an L-bracket 114 that is welded to the outer element 58. To secure this end of the cylinder 112 to the L-bracket 114, a pin 116 slides through the end of the cylinder 112 and supports 118, and then is secured to L-bracket 114 using a fastener, washer and locknut or other fastening arrangements known in the art.

The pneumatic cylinder 112 is electronically linked to the control system 26 in the operator's cab 24. If the operator desires to immobilize an extending member, the operator extends the small pneumatic cylinder 112, which pushes the latch 98 downward over a locking pin 120 (best seen in FIG. 2) that attaches to and projects from the housing 86 (shown in FIGS. 1, 3 and 4). Once the latch 98 is positioned over the locking pin 120, the extending member 32 is locked into place. To release the extending member 32, the operator manipulates the control system 26, which activates the pneumatic cylinder 112 to retract, pulling the latch 98 upward and thereby releasing the locking pin 120. Now the extending member 32 is free to reciprocally move toward or away from the frame 20.

In the preferred embodiment, only one extending member 32 or 34 is operational at a time. Therefore, if a rail tie 18 needs replacement along rail 16*a*, the extending member 34, and the corresponding gripping mechanism 38 are locked in place by the corresponding latch 98. Only the extending member 32 is operable, and the gripping mechanism 36 is extendable. After locking the second gripping mechanism 38 in place when extension of the mechanism 36 is required, fluid also fills the blind end 92 of the hydraulic cylinder 84*a*, and the fluid pushes against the rod end 94. Since the mechanism 38 is locked in place, fluid pressure inside the blind end 92 of the cylinder 84*a* creates a pushing force against the hydraulic cylinder 84*b*.

At the same time, the blind end 92 of second hydraulic cylinder 84*b* is filled with fluid. The pressure of the fluid inside the blind end 92 pushes the piston (not shown) against the rod end 94. The rod 95 moves the inner element 56 of first extending member 32 outwardly from the frame 20. The combined force of the movements of the hydraulic cylinders, 84*a* and 84*b*, working in series cause the inner element 56 to move at generally double the speed of a single hydraulic cylinder system, the type employed in conventional tie replacement machines. Thus, in operation, one gripping mechanism 36, 38 will be immobilized when work is to be performed by the other mechanism.

Now referring to FIG. 5, wear pads 126 are removably attached to each side of an end 128 of the outer element 58, and to each side of the second end 61 (FIG. 2) of the inner element 56 (not shown in FIG. 5) by washers 132 and threaded fasteners 134, to facilitate the smooth reciprocal movement of the extending members 32 and 34. However, the bottom side of the end 128 of the outer element 58 is configured with the roller 104 and not a wear pad. Furthermore, between the pads 126 and the outer element 58 are shims 136. The shims 136 are used to adjust the position of the wear pads 126 in relation to the outer element 58. As the pads 126 wear down due to the sliding friction between inner element 56 and outer element 58, the shims 136 are added below the pads 126 to maintain positioning of the wear pads 126 on the outer element 58. Each pad 126 is configured to reduce the sliding friction between the inner element 56 and the outer element 58 during extension and retraction of the extending members 32 and 34.

The wear pads 126 are made of a resilient type of material such as rubber, that can provide adequate cushioning between the inner element 56 and the outer element 58 while allowing for the fluent reciprocal movement of the elements 56 and 58 relative to each other during operation. Other types of resilient material as known in the art may also be used to form the wear pads 126 in this configuration.

In conventional machines of this type, wear pads are removably attached along the full length of the extending members. As a result, some of these wear pads are several feet in length. The substantial length of the wear pads causes a significant problem. Because the wear pads wear unevenly due to varying friction points, one end of a pad normally wears more quickly than another end. Unfortunately, since each wear pad is a single, long solid pad, the entire wear pad must be replaced even though a majority of the pad is still in good condition. Therefore, replacement of the conventional, longer wear pads is difficult and time-consuming, because both sides of the machine must be disassembled in order to change each worn wear pad.

An advantage of the wear pads 126 used in the present apparatus, is that the present wear pads are manufactured in generally smaller sizes and are removably attached to the inside walls of the outer element 58. The generally smaller size of the wear pads 126 significantly reduces the cost and time of replacing the longer wear pads used by the conventional machines. Also, because the wear pads 126 do not extend along the entire length of the extending members 32, 34, they are easier to remove and replace.

Referring again to FIG. 2, once the first extending member 32 extends over first rail 16*a*, the gripping mechanism 36 is maneuvered into place to grab a rail tie 18. Each gripping mechanism 36, 38 includes the housing 86, a jaw 138, a second jaw 140, a first hydraulic cylinder 142 and a second hydraulic cylinder 144. The housing 86 is attached to the inner element 56 by threaded fasteners, welding or other fastening technology as is known in the art. Also, the housing 86 projects downward from inner element 56 and provides the main support for the first gripping mechanism 36.

The first jaw 138 and second jaw 140 are disposed on either side of the housing 86. Each jaw 138, 140, attaches to a gripper assembly 146. The gripper assembly 146 is pivotally attached to a pivot bracket 148. In addition, to facilitate the opening and closing of the jaws 138, 140, the first hydraulic cylinder 142 attaches to an upper end 150 of the gripper assemblies 146. The ends of the first hydraulic cylinder 142 are configured as clevis brackets, which are secured to the upper ends 150 of the gripper assemblies 146 by pins 152 and cotter fasteners (not shown) or other fastening devices.

Each pivot bracket 148 is pivotally attached to the housing 86 by gripper pins 154 and bushings (not shown), where the pins slide into an opening in the housing 86 and through a corresponding opening in the bracket 148. Once the pin 154 has pivotally attached the bracket 148 to the housing 86, it is fastened into place by a nut 156. As attached, the brackets 148 may pivot about the pins 154 so that the gripper assemblies 146 and corresponding jaws 138, 140 may be pivoted or tilted as needed to grasp a rail tie 18.

A second hydraulic cylinder 144 is utilized to promote the pivoting movement of the pivoting brackets 148. A first end 158 of the second hydraulic cylinder 144 is pivotally secured to ears 162 located on the pivot bracket 148. A second end 160 of the second hydraulic cylinder 144 is pivotally attached to the housing 86. A hollow tube 164 is welded or formed on the second end 160, such that a pin or other fastening rod may be inserted through the tube 164. The tube 164 is aligned with corresponding holes located on each side of the housing 86. Once the holes are aligned with the hollow tube 164, a pin 166 is inserted through the holes and is secured to the housing 86 by a threaded fastener or similar device known in the art.

In operation, the second hydraulic cylinder 144 is controlled by an operator, and extends or retracts depending on the desired positioning of the jaws 138, 140. Retracting the second hydraulic cylinder 144 tilts the jaws 138, 140 downward towards the ground, and extending the cylinder 144 tilts the jaws 138, 140 upward away from the railroad track 16. In addition, the first hydraulic cylinder 142 is connected between the first jaw 138 and the second jaw 140 at a normal orientation to the cylinder 144. The first hydraulic cylinder 142 also extends and retracts under an operator's control, to grip or release a rail tie 18. Extending the first hydraulic cylinder 142, pivots the first jaw 138 and second jaw 140 inward or towards each other for gripping a rail tie. For releasing a rail tie, the operator retracts the first hydraulic cylinder 142, causing the first jaw 138 and the second jaw 140 to spread apart or open. As described above, the manifold 62 contains valves for controlling the operation of the cylinders 142, 144 including the gripping pressure of the cylinder 142.

It is contemplated that the present apparatus 10 may be manufactured as a separate unit, apart from the railway maintenance machine 12, that can be attached to a new machine or retrofitted to modify an existing machine.

The present apparatus 10 provides increased stability and strength during operation of the extending members 32, 34 because of the unique non-axial placement of the extending members along the frame. In addition, the double-acting hydraulic cylinders 84 attached between the gripping mechanisms 38 substantially increase the speed of the extending members during a repair operation, as well as, provide strength and durability to the cylinders themselves. Also, the smaller wear pads 126 attached to each extending member, decreases the replacement costs and the maintenance time needed to replace the conventional wear pads.

Figure 6:
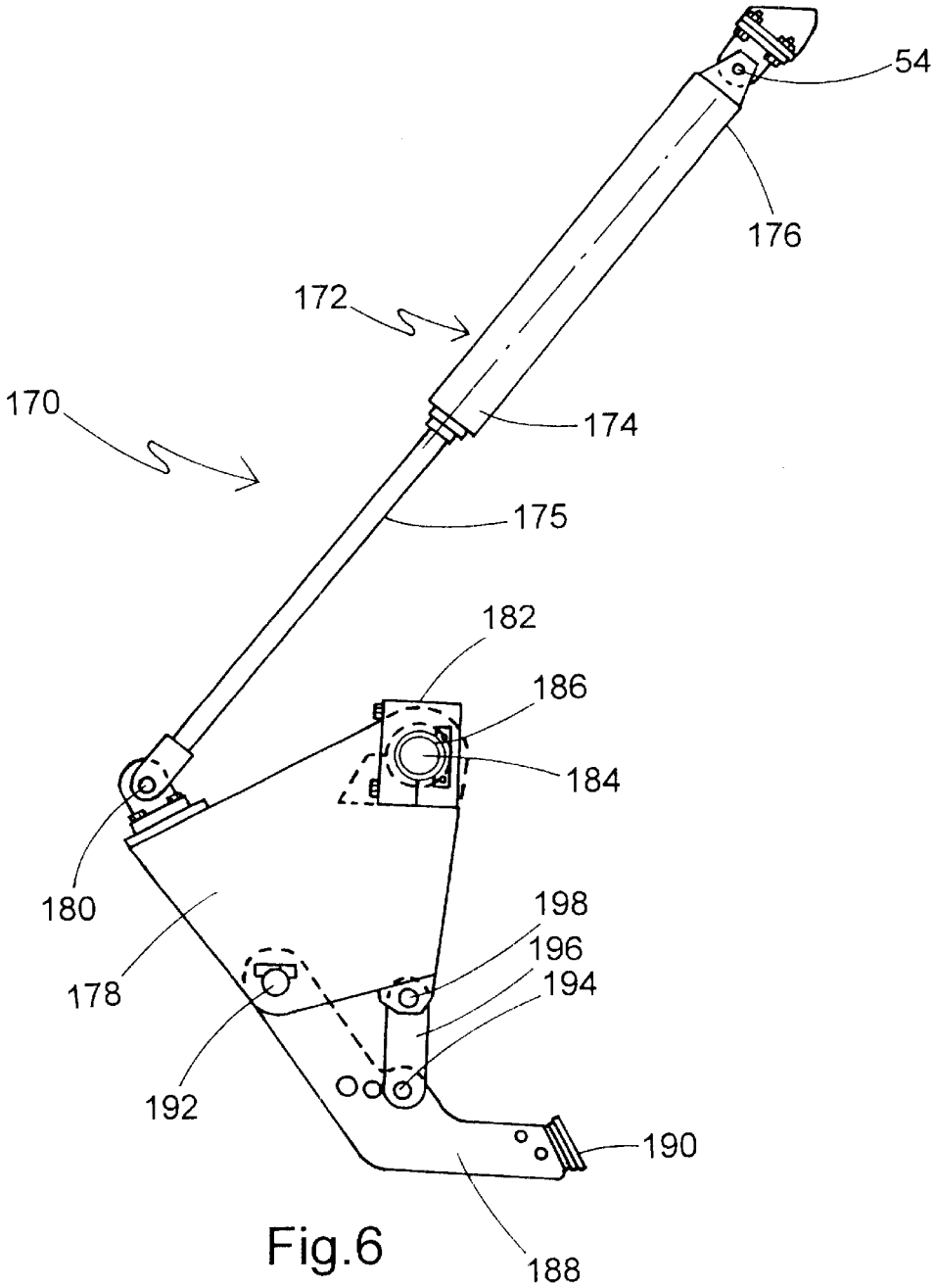
FIG. 6 is a side elevational viewof a kicking mechanism.
Figure 7:
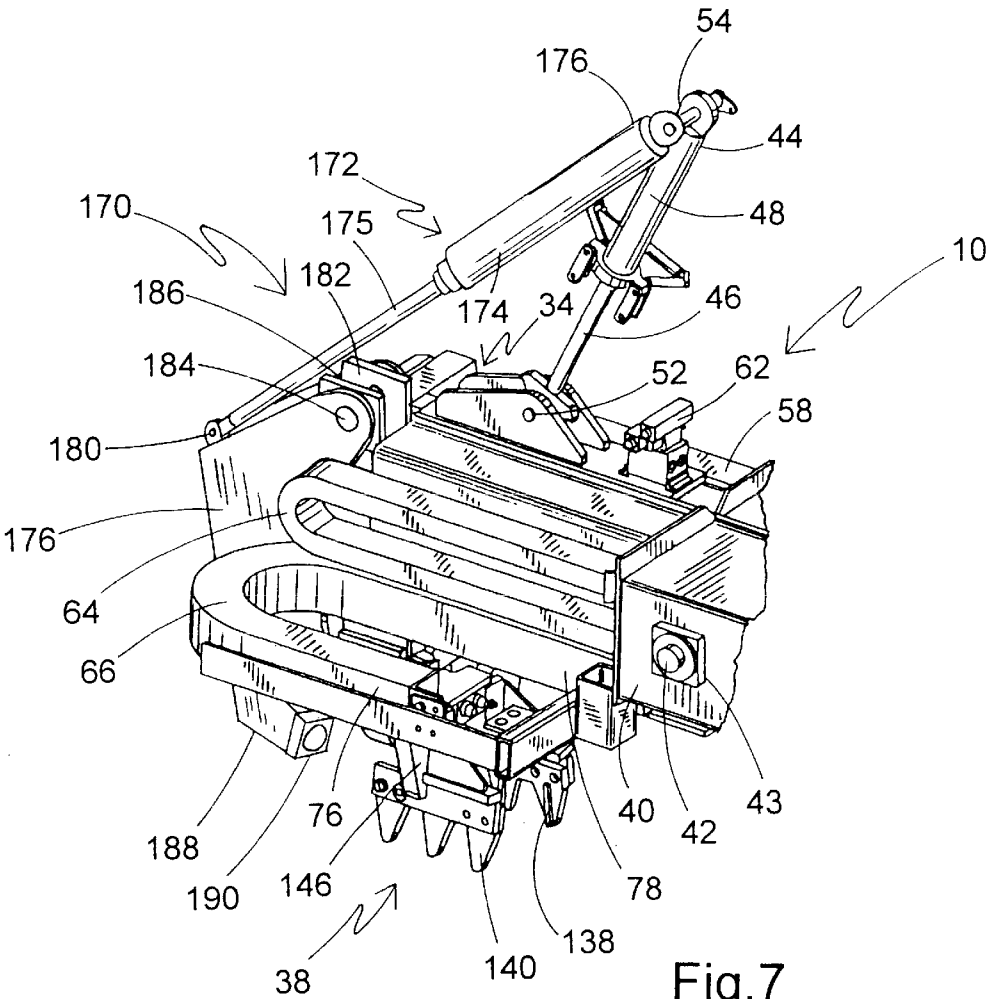
FIG. 7 is a partial top perspective view of the present rail tie replacement apparatus with a kicking mechanism.

Referring now to FIGS. 6 and 7, a kicking mechanism, generally designated 170, may also be added to the rail tie replacement apparatus 10 on the opposite end of the outer element 58. It is preferred that the kicking mechanism 170 be associated with both sides 20*a* and 20*b* of the apparatus 10, however, a single kicking mechanism may be added to either side of the apparatus. In use, the kicking mechanism 170 applies a pushing or an impact force to an end of the rail tie 18 opposite the end being grasped by the gripping mechanism 36, in an effort to loosen difficult or stuck rail ties for their removal.

In particular, the kicking mechanism 170 includes a kicking hydraulic cylinder 172 having a kicking rod end 174 and a kicking blind end 176. A piston rod 175 extends from the rod end 174. The kicking blind end 176 is secured to the frame 20 by a clevis type bracket or an eyelet mating with the flanged pin 54. On the opposite side, the piston rod 175 is attached to a boot 178 by a pivot pin 180. A bracket 182 on the outer element 58 secures the boot 178 with a pin 184, forming a main pivot point 186. On the boot 176 is a contact member 188 with a contact shoe 190 that actually makes contact with the rail tie 18. The contact member 188 is pivotally secured to the boot 178 with a pair of pins 192, 194, the latter being connected by a link 196 to a second pin 198 connected to the boot 178.

From a retracted position, in which the kicking hydraulic cylinder 172 is retracted and the boot 178 is in a raised position, the operator can give an instruction to extend the kicking hydraulic cylinder 172 which pivots the boot 178 so that the contact end 188 lowers, pushing or striking the end of the rail tie 18. The downward pivoting force, and the weight of the boot 178 combine to create an impact force which loosens the rail tie 18 so that it may be removed more easily.

While a particular embodiment of the present rail tie replacement apparatus has been shown and described, it will be appreciated by those skilled in the art that changes and modifications may be made thereto without departing from the invention in its broader aspects and as set forth in the following claims.

What is claimed is:

1. A rail tie replacement apparatus, comprising:

a frame having a first side associated with a first side of a railroad track, and a second side associated with a second side of the railroad track;

gripping means disposed on each of said sides of said frame and configured for grasping rail ties located in the track;

extending means attached to said frame, said extending means including a first extending member and a second extending member in a non-axial relationship to each other, and configured for positioning said gripping means relative to the rail ties; and each of said first and second extending members have only two telescoping elements being slidingly engaged relative to each other, one of said elements being secured to said corresponding gripping means to reciprocally operate between an extended position and a retracted position.

2. The apparatus as defined in claim 1 wherein said first and second extending members are disposed adjacent to each other on said frame.

3. The apparatus as defined in claim 1 wherein said first extending member reciprocates in an opposite direction to said second member so that each said extending means orients said corresponding gripping means on an associated side of the track.

4. The apparatus as defined in claim 1 wherein said telescoping elements include an inner element configured for connection to said gripping means, and an outer element secured to said frame and dimensioned for slidably accommodating said inner element.

5. The apparatus as defined in claim 1 wherein said extending means further comprises resilient material removably attached to said extending means for reducing sliding friction between said telescoping elements.

6. The apparatus as defined in claim 5 wherein said extending means has an inner end and an outer end, and said resilient material further includes an inner pad and an outer pad, said inner pad being removably attached to said inner end and said outer pad being removably attached to said outer end.

7. The apparatus as defined in claim 1 further including fluid powered means substantially parallel to said extending means, configured for controlling the movement of said extending means.

8. The apparatus as defined in claim 7 wherein said fluid powered means includes a pair of fluid powered cylinders disposed in a generally linear relationship.

9. The apparatus as defined in claim 8 wherein said extending means includes a pair of telescoping extending members, each associated with a corresponding side of the frame and each having an inner element reciprocally movable relative to an outer element fixed to said frame, said fluid powered means includes a pair of fluid powered cylinders each with a blind end and a rod end, said rod ends being connected to a corresponding inner element.

10. The apparatus as defined in claim 8 wherein said extending means is constructed and arranged so that only one of said extending members is operable at a time, and said fluid power means is constructed and arranged so that both of said fluid powered cylinders facilitate the reciprocal movement of said single operating extending member.

11. The apparatus as defined in claim 10 further including a latch associated with each said telescoping extending member so that one of said telescoping extending members may be immobilized while said other telescoping extending member is operated.

12. The apparatus of claim 1, further comprising a kicking mechanism associated with at least one of said first side and said second side, and configured for applying a force to ends of selected rail ties.

13. A rail tie replacement apparatus for use with a railroad track, said apparatus comprising:

a frame having a first side associated with a first side of a railroad track and a second side associated with a second side of the railroad track;

gripping mechanisms configured to each side of said frame for grasping rail ties, each mechanism disposed for operation on an associated side of the track, at least two telescoping extending members being in a non-axial relationship to each other, and configured for positioning said gripping mechanisms relative to the rail ties;

said at least two telescoping extending members are disposed adjacent to each other on said frame;

each of said at least two telescoping extending members are slidingly engaged relative to each other and secured to said corresponding gripping mechanism to reciprocally operate between an extended position and a retracted position;

one of said at least two telescoping extending members reciprocates in an opposite direction to the other of said at least two telescoping extending members so that each of said at least two telescoping extending members orients said corresponding gripping mechanism on an associated side of the track; and said at least two telescoping extending members each have only two telescoping elements, an inner element configured for connection to said gripping mechanisms, and an outer element secured to said frame and dimensioned for slidably accommodating said inner element.

14. The apparatus as defined in claim 13 wherein said at least two telescoping extending members further comprise resilient material removably attached to said at least two telescoping extending members for reducing sliding friction between said telescoping elements.

15. The apparatus as defined in claim 14 wherein each of said at least two telescoping extending members have two ends, and said resilient material further includes an inner pad and an outer pad, said inner pad being removably attached to an inner end of each of said at least two telescoping extending members and said outer pad being removably attached to an outer end of each of said at least two telescoping extending members.

16. The apparatus as defined in claim 13 further including at least two fluid powered cylinders substantially parallel to said at least two telescoping extending members and configured for controlling the reciprocal movement of only one of said at least two telescoping extending members at a time.

17. The apparatus as defined in claim 16 wherein said at least two telescoping extending members are each associated with a corresponding side of said frame and each having an inner element reciprocally movable relative to an outer element fixed to said frame, said at least two fluid powered cylinders include a blind end and a rod, said rods each being connected to a corresponding inner element.

18. The apparatus as defined in claim 13 wherein said at least two fluid powered cylinders are disposed in a generally linear relationship.

19. The apparatus as defined in claim 18 wherein said at least two telescoping extending members are constructed and arranged so that only one of said at least two telescoping extending members are operable at a time, and said at least two fluid powered cylinders are constructed and arranged so that both of said at least two fluid powered cylinders facilitate the reciprocal movement of said single operating telescoping extending member.

20. The apparatus as defined in claim 17 further including a latch associated with each of said at least two telescoping extending members so that one of said telescoping extending members may be immobilized while said other telescoping extending member is operated.

21. The apparatus of claim 13, further comprising a kicking mechanism associated with at least one of said first side and said second side, and configured for applying a force to ends of selected rail ties.

22. A rail tie replacement apparatus for use with a railroad track on either side of a railroad repair machine, said apparatus comprising:

a frame having first side and a second side;

gripping mechanisms configured to said first and second sides of said frame for grasping rail ties, each mechanism disposed for operation on an associated side of the track;

at least two telescoping extending members each attached to said frame and to an associated gripping mechanism and configured for positioning said gripping mechanism relative to the rail ties; and at least two fluid powered cylinders substantially parallel to said at least two telescoping extending members and configured so that all of said cylinders control the reciprocal movement of only a selected one of said at least two telescoping extending members at a time;

said at least two telescoping extending members are constructed and arranged so that only one of said at least two telescoping extending members are operable at a time, and said at least two fluid powered cylinders are constructed and arranged so that all of said at least two fluid powered cylinders facilitate the reciprocal movement of said single operating telescoping extending member.

23. The apparatus as defined in claim 22 wherein said at least two fluid powered cylinders are disposed in a generally linear relationship.

24. The apparatus as defined in claim 22 wherein said extending members are each associated with a corresponding side of the frame and each having an inner element reciprocally movable relative to an outer element fixed to said frame, said fluid powered cylinders each with a blind end and a rod end, said rod ends being connected to a corresponding inner element.

25. The apparatus as defined in claim 22 further including a latch associated with each said telescoping extending member so that one of said telescoping extending members may be immobilized while said other telescoping extending member is operated.

26. The apparatus defined in claim 25 wherein said fluid power cylinders are connected in series so that simultaneous increased fluid pressure in each of said fluid powered cylinders facilitates the movement of said telescoping extending member being operated.

27. The apparatus of claim 22, further comprising a kicking mechanism associated with at least one of said first side and said second side, and configured for applying a force to ends of selected rail ties.

28. A tie replacement machine for removing and replacing rail ties on a railroad track, comprising:

a frame having a first side and a second side;

at least one gripping mechanism provided on each side of said frame for grasping the rail ties, each mechanism disposed for operation on an associated side of the track;

at least two telescoping extending members being in a non-axial relationship to each other, and configured for positioning said gripping mechanisms relative to the rail ties;

fluid powered means having a pair of fluid powered cylinders disposed in a generally linear relationship;

said extending members are constructed and arranged so that only one of said extending members is operable at a time, and said fluid power cylinders are constructed and arranged so that both of said fluid powered cylinder facilitate the reciprocal movement of said single operating extending member.

29. The machine as defined in claim 28 wherein said at least two extending members each include only two telescoping elements being slidingly engaged relative to each other, one of said elements being secured to said corresponding gripping mechanism to reciprocally operate between an extended position and a retracted position.

30. The machine as defined in claim 28 further including an adjustable apparatus for vertically adjusting the position of said gripping mechanisms relative to said frame.

31. The apparatus of claim 26, further comprising a kicking mechanism associated with at least one of said first side and said second side, and configured for applying a force to ends of selected rail ties.

* * * * *